US008167032B2

(12) United States Patent
Lumbye et al.

(10) Patent No.: US 8,167,032 B2
(45) Date of Patent: May 1, 2012

(54) ANNULUS SEALING ASSEMBLY

(75) Inventors: Peter Lumbye, Måløv (DK); Imran Abbasy, Islamabad (PK)

(73) Assignee: Maersk Olie OG Gas A/S, Copenhagen (DK)

( * ) Notice: Subject to any disclaimer, the term of this patent is extended or adjusted under 35 U.S.C. 154(b) by 248 days.

(21) Appl. No.: 12/245,482

(22) Filed: Oct. 3, 2008

(65) Prior Publication Data

US 2009/0090502 A1 Apr. 9, 2009

Related U.S. Application Data

(60) Provisional application No. 60/977,989, filed on Oct. 5, 2007.

(30) Foreign Application Priority Data

Oct. 5, 2007 (DK) ..... 2007 01439

(51) Int. Cl.
*E21B 33/12* (2006.01)

(52) U.S. Cl. ..... 166/187

(58) Field of Classification Search ..... 166/187, 166/387

See application file for complete search history.

(56) References Cited

U.S. PATENT DOCUMENTS

| | | | | |
|---|---|---|---|---|
| 3,960,211 | A | 6/1976 | Hutchinson et al. | |
| 4,378,843 | A | 4/1983 | Suman, Jr. | |
| 7,938,186 | B1 * | 5/2011 | Badalamenti et al. | 166/285 |
| 2003/0029611 | A1 | 2/2003 | Owens | |
| 2004/0020644 | A1 * | 2/2004 | Wilson et al. | 166/250.01 |
| 2004/0020709 | A1 | 2/2004 | Wilson et al. | |
| 2004/0055758 | A1 | 3/2004 | Brezinski et al. | |
| 2005/0115708 | A1 | 6/2005 | Jabusch | |
| 2006/0065408 | A1 | 3/2006 | Green et al. | |
| 2006/0124310 | A1 | 6/2006 | Lopez de Cardenas et al. | |
| 2007/0144731 | A1 | 6/2007 | Murray et al. | |
| 2008/0029303 | A1 * | 2/2008 | Codazzi et al. | 175/57 |

FOREIGN PATENT DOCUMENTS

| | | |
|---|---|---|
| EP | 0 999 338 A1 | 5/2000 |
| EP | 1 149 980 | 4/2001 |
| GB | 2 335 683 | 9/1999 |
| WO | WO 00 63524 | 10/2000 |
| WO | WO 01/33045 A1 | 5/2001 |
| WO | WO 2004/065758 | 8/2004 |

OTHER PUBLICATIONS

International Search Report for corresponding International Patent Application PCT/EP2008/063216, dated May 28, 2009.

* cited by examiner

*Primary Examiner* — William P Neuder

(74) *Attorney, Agent, or Firm* — Brinks Hofer Gilson & Lione

(57) ABSTRACT

An assembly arranged in a well bore and run in conjunction with a perforated or a non perforated liner has an inflatable packer section prepared for being expanded by fluid and a valve device for opening and closing of fluid communication into the inflatable packer section. The assembly also has a fluid section connected to the inflatable packer section. The fluid section holds a fluid that is delivered into and used to inflate the inflatable packer section. An energy section in the assembly contains an energy source for delivering the fluid from the fluid section into the inflatable packer section. A triggering section includes a control for the energy source and/or the valve device. The triggering section can control the delivery of the fluid into the inflatable packer section. The triggering section also includes a communicator that signals a triggering device for initiating the expanding of the inflatable packer section.

16 Claims, 9 Drawing Sheets

ANNULUS SEALING ASSEMBLY

RELATED APPLICATIONS

The present patent document claims the benefit of the filing date under 35 U.S.C. § 119(e) of Provisional U.S. Patent Application Ser. No. 60/977,989, filed 5 Oct. 2007, and the benefit of priority to Danish Patent Application No. PA 2007 01439, filed 5 Oct. 2007, the entirety of each of which are incorporated herein by reference.

TECHNICAL FIELD

The invention generally relates to an assembly to be run in conjunction with a perforated or non-perforated well tubular and for being arranged in a wellbore. In particular, the invention relates to a sealing system, such as an anchor or a packer, which includes a triggering section, an energy source section, and an inflatable packer section.

After a well has been drilled, a well tubular is introduced into the well. The well tubular can be a casing or a liner. The outside diameter of the casing is smaller than the inside diameter of the wellbore, providing an annular space, or annulus, between the casing and the wellbore. The well tubular is perforated at one or more zones to allow hydrocarbons to flow into the tubular. Sometimes the well tubular may be sealed off from a part of the annular space. Sealing systems, such as packers or anchors, may be used in the oilfield.

RELATED ART

Packers may be used to seal the annulus between a casing or a liner string and a surface exterior to the string, such as an open wellbore or a casing and often packers are actuated by hydraulic pressure which is transmitted either through the bore of the string, the annulus, or a separate line. Other packers are actuated and controlled by electricity via an electric cable which runs from the wellbore to the surface. Normally the cable is deployed from the ground surface. The packers may also be actuated by a ball dropped from the surface into the well to create a seal. The seal may build up pressure in the wellbore and activate inflation of the packer.

The packer may also comprise swellable materials. GB 2411918 describes a system and method to seal off a space surrounding a well tubular with materials that swell and create a seal when the material comes into contact with a triggering fluid. U.S. Pat. No. 6,302,214 B describes another method for providing annular isolation in a well liner using inflating packers.

Because of the very harsh conditions in oil wells and the remote locations of these wells, which are often thousands of feet below the surface, methods of controlling the operation of downhole devices, such as inflatable packers, may be severely challenged. This challenge may be especially severed if multiple packers are required along a pre-perforated tubular, in which case it may not be possible to seal off the perforations to build up pressure in the wellbore to inflate the packers.

OBJECT OF THE INVENTION

This invention may remove the problems with known techniques and provide a new and more reliable assembly. The assembly may make it possible to inflate packers without the use of an electric cord or hydraulic line between the packers and the ground surface. The ability to activate and control such systems without worrying about electric cable or hydraulic line deployment may give the ability to control production from the wellbore in an easier and more reliable way.

For example, the assembly may be of such a size as to require a larger hole to be drilled or a liner having a smaller inner diameter to be deployed into the wellbore in order to accommodate the assembly. The inner diameter of the assembly may equal the full bore inner diameter of the liner such that the assembly does not obstruct any work string that may be run through the liner.

SUMMARY OF THE INVENTION

The objects of the invention may be achieved by an assembly run in conjunction with a perforated or non-perforated liner, which may be arranged in a wellbore. The assembly may comprise an inflatable packer section that may be expanded by fluid. The inflatable packer section may be provided with valve means for opening and closing of fluid communication into the inflatable packer section; a fluid section being in fluid communication with said inflatable packer section and comprising a suitable fluid for being delivered into said inflatable packer section; an energy section comprising an energy source for the delivering of fluid into the inflatable packer section; a triggering section comprising means for controlling of said energy source and/or for controlling of said valve means thereby being capable of controlling the delivery of said fluid into said inflatable packer section, said triggering section further being provided with means for communication with a triggering device for initiating the expanding of said inflatable packer section.

In one embodiment of the invention the assembly may be run in conjunction with a perforated or a non-perforated well tubular into a wellbore. The assembly comprises an inflatable packer section. The inflatable packer section may be equipped with one or more packers which may be inflated by fluid. The inflatable packers may be used on the outside of a well tubular. However, the packers may be used in any situation or location where down hole packers are required to be inflated.

The packer section may be provided with one or more valves for opening and closing of fluid communication into the inflatable packer section. The energy required for delivering of fluid into the inflatable packer section may be delivered by a suitable energy source, such as by one or more batteries, which may be contained in an energy section. To control the expanding of the inflatable packers in the packer section the assembly may further comprise a triggering section. The triggering section may be capable of controlling the energy source and/or controlling of the valve means. The triggering section may be capable of controlling the delivery of fluid into the inflatable packer section. The triggering section may be a "trigger/detect function" that is capable of controlling the flow of inflation fluid to the packer. The triggering section may release the flow of fluid by opening of valve(s) to the packer, or the triggering section may turn on an electrical pump that transfers the fluid into the packer. The triggering section may be provided with a means for communication with a triggering device for initiating the expanding of the inflatable packer section.

The triggering device may be a pre-set time delay. Alternatively, the triggering device may be based on RFID (radio frequency identification) technology where RFID chips are detected when passing through the assembly. The triggering could also be accomplished in other ways, such as by sending an acoustic signal through the walls of the well tubulars.

In one embodiment of the invention, the assembly comprises a fluid section which is in fluid communication with the inflatable packer section. The fluid section contains a fluid which is suitable for being delivered into the inflatable packer section and thereby expanding the packers. The fluid used to inflate the packers might be cement but other fluids may be used to activate the packer, including brines, one- or two-compound epoxy fluids, gels, inert gas, or other chemicals, including completion fluids. The fluid(s) may include fluid that occurs naturally in a well.

In one embodiment of the invention, the fluid section is adapted for storing of a hardenable two-component fluid system that hardens after mixing of the two fluids. In this embodiment, the two fluids are kept separated in the fluid section until the fluids are delivered into the inflatable packer section. For facilitating the mixing of the two fluids prior to injection into the packer section, the assembly may comprise a connection (mixing) section arranged between the packer section and the fluid section.

Although this description only has discussed a well tubular of circular cross section, the concept may be applicable to different cross sections, such as flat-oval rectangular etc. The assembly may be made as separate modules (sub-assemblies) comprising one or more sections. Alternatively, the assembly may be made as a single unit comprising an energy section, a packer section, a fluid section and a triggering section. Packers may not necessarily have a circular geometry.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The systems and methods may be better understood with reference to the following drawings and description. The elements of the figures are not necessarily to scale, emphasis instead being placed upon illustrating the principles of the system. In the figures, like-referenced numerals designate corresponding parts throughout the different views.

DETAILED DESCRIPTION OF THE PREFERRED EMBODIMENTS

Tubulars are used for many purposes in the oil production industry. For example, they may be used for reinforcing a well and transporting oil from a reservoir to the surface.

Figure 1:
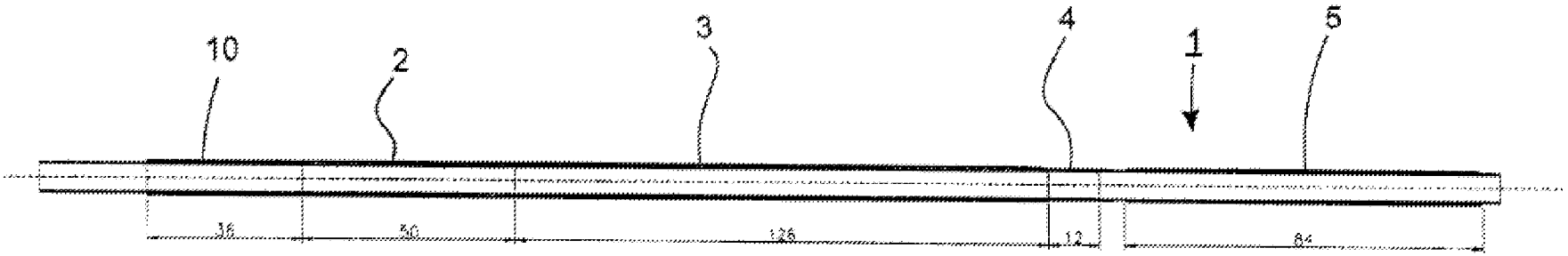
FIG. 1 shows an assembly according to an embodiment of the invention.

FIG. 1 shows an embodiment of the invention where a tubular 1 of a type that may be used for oil extraction is arranged in an oil well. The tubular 1 may be a casing with a diameter of about 15.24 cm (7 inches). In connection with the tubular wall, means may be arranged for establishing a number of external packers such that gas or oil may be produced from selected areas of the oil reservoir.

The packer may also support a production pipe, tubular or other equipment. These packers may be expanded from the outside of the well tubular. For example, the packers may be expanded outwards to provide a seal with an abutment on the formation or to provide a seal with the inside of another well tubular surrounding the inside tubular. The other well tubular may be a casing surrounding the inside tubular. The material and the energy for such expansion may be supplied from the ground surface, high-pressure injection of cement or the like being performed for expanding the packer.

A part or all of the equipment or material necessary for establishing these barriers formed from packers may be contained in the pipe wall of a well casing or any other tubulars used in an oil well. Such static properties may make the tubular suitable not only for oil production but also may provide for a tubular with external and internal dimensions suitable for insertion between other tubulars in a conventional oil well. Such tubular units may be inserted between conventional pipes as a casing liner.

Depending on where and how the assembly is to be used, the requirements for the volume of cavities for energy storage and other purposes may vary. In response to these variations, the tubular units may be integrated in a single tubular section. Alternatively, the tubular units may be in several tubular sections that are subsequently combined prior to being conveyed down into the well. Where the assembly comprises a number of independent tubular sections, means may be provided for transferring the material, energy and/or electronic signals necessary for the expansion process between the tubular sections.

A tubular with an essentially unchanged flow area may be achieved by storing in the tubular wall the means necessary for establishing the packer. A number of these prepared tubular sections may be introduced into an oil well without significantly influencing the well operation.

FIG. 1 further shows cavities provided in the tubular wall. In those cavities equipment may be arranged for establishing an external packer. The tubular section 1 comprises a number of tubular sections, each of which comprises constituent components for establishing a packer on the tubular outside. The assembly of FIG. 1 comprises the following sections:

- A tubular section 10 (trigger section) that contains an activator unit initiating and controlling the expansion of the packer (trigger sub);
- A tubular section 2 (energy section) that supplies the requisite energy for expanding the packer;
- A tubular section 5 (packer section) that contains one or more expandable packer(s);
- A tubular section 3 (fluid section) that contains a suitable fluid, such as a two-component system that sets following admixture, for being injected into the expandable packer for establishment of a barrier;
- A tubular section 4 (mixing section) that contains means for mixing the fluids.

Tubular sections 10, 2, 5, 3, 4 may be constituents of a casing, liner or any other tubular element that partakes in an oil well.

Speed, time and extent of the inflation of the packer may be controlled by the trigger unit in the tubular section 10. By providing the assembly with a trigger unit (as will be explained in further detail below) the assembly according to the invention may be conveyed down into an oil well in its non-activated state and then be activated to establish a barrier on the outside of the tubular when there is a need. The need may arise due to ingress of water or to delimit a part of the well. The establishment of a packer may also be due to a need for supporting a production tubular. These two scenarios are fundamentally different since, as opposed to the need for preventing ingress of water, which often occurs unpredictably, the need for establishing a supportive packer is usually predictable. The choice of a suitable trigger unit may be based on this need.

Thus, one embodiment of the invention comprises a trigger unit containing a timer that starts the expansion after a predetermined period of time. This embodiment may be particularly suitable for assemblies that comprise a packer unit capable of supporting a tubular section. The assembly may be introduced in a non-activated state into the well at the site where support is desired. The trigger unit may activate expansion of the packer. A timer may be set in advance to initiate the expansion of the supportive packer after a suitable period of time (after which experience has shown the tubular section to be properly located).

According to a further embodiment the expansion may be controlled by a trigger unit that initiates expansion only when it receives a signal. The signal may be based on radio technology, such as RFID (Radio-Frequency Identification) technology, where a sensor is capable of (at a distance of upwards of several meters) detecting and identifying an RFID tag. By using RFID technology, a high degree of reliability may be obtained such that the assembly does not unprovokedly initiate an expansion of the packer. Furthermore, several independent assemblies may be introduced into the well without having concerns about one or more assemblies shutting off productive areas due to malfunction.

Several independent assemblies that include RFID technology may be arranged in sites where there is a concern that, at any point in time, it may be convenient to establish a barrier against ingress of water. When such need arises, the relevant assembly may be activated by pumping the electrode specific to that particular assembly from the surface and down through the tubulars. When the trigger unit of the assembly detects that the relevant RFID tag passes through the tubular, it may initiate and control the expansion of the packer. In this manner, the costs of blocking water-producing areas may be reduced. These costs may be very high, since, it is generally necessary to first discontinue the oil recovery and then lower suitable equipment into the well. When several mutually independent RFID-based systems partake as elements (in any number) inserted between the conventional tubulars of a well, one option may be to selectively activate a number of assemblies by pumping liquid containing RFID electrodes from the surface of the well and down through the tubulars.

According to a further embodiment of the invention, the trigger unit may be based on acoustic transmission of data between the surface and the trigger unit 10. The acoustic transmission may occur through acoustic signals transmitted through the tubulars of the well. The trigger unit 10 may be provided with recording equipment (not shown) which is able to read physical parameters in the well, such as temperature, pressure or the presence of water. For the recording equipment to function optimally, the equipment or parts of the equipment may be arranged on the outside of the tubular. By providing the trigger unit with recording means and a means for acoustically transmitting data between the recording means and the ground surface, it is possible not only to monitor the well, but also to establish barriers in other suitable places as soon as the need arises. This embodiment of the invention may be combined with other methodologies for transmitting signals between the trigger unit 10 and the surface above the well. For instance, it may be advantageous if the trigger unit 10 has integral means for acoustic transmission of well parameters to the surface and simultaneously means for activating the expansion means of the packer by means of both acoustic signals and signals provided by means of RFID-tags.

The assembly may comprise a section 2 that features means for establishing the energy requisite for operating the assembly. Such means for establishing energy may rely on batteries, compressed gas, or they may utilise the pressure differences between well pressure and atmospheric pressure.

The assembly may also comprise a tubular section 3 (fluid section) in which a fluid is contained in a cavity in the wall of a tubular section suitable for expanding one or more packers (packer section) 5.

As shown in FIG. 1, a connection sub is arranged between the packer section 5 and the fluid section 3. The connection sub may be where two-component epoxy systems are mixed prior to being injected into the packer. The expansion of the packer need not be limited to two-component glue systems. The expansion may also be based on a single fluid that makes the packer expand, such as by means of a swellable material.

A tubular may be established in which all the units are incorporated into the wall of the tubular without significantly and adversely affecting the cross-sectional area of the tubular. In one embodiment of the invention where the cross-sectional internal area remains unchanged (fullbore), the assembly comprises sections of the following lengths:

Trigger section: 0.91 meters (36 inches);
Energy section: 1.27 meters (50 inches);
Fluid section: 3.20 meters (126 inches);
Mixing section (connection sub): 0.30 meters (12 inches);
Packer section: 2.13 meters (84 inches).

In another embodiment of the invention, the internal diameters of the tubular sections 10, 2, 3, 4, 1, 5 may be slightly reduced, but the sections may still partake as conventional well tubulars. In this embodiment, the assembly comprises sections of the following lengths:

Trigger section: 0.91 meters (36 inches);
Energy section: 0.66 meters (26 inches);
Fluid section: 1.47 meters (58 inches);
Mixing section (connection sub): 0.30 meters (12 inches);
Packer section: 2.13 meters (84 inches).

Figure 2:
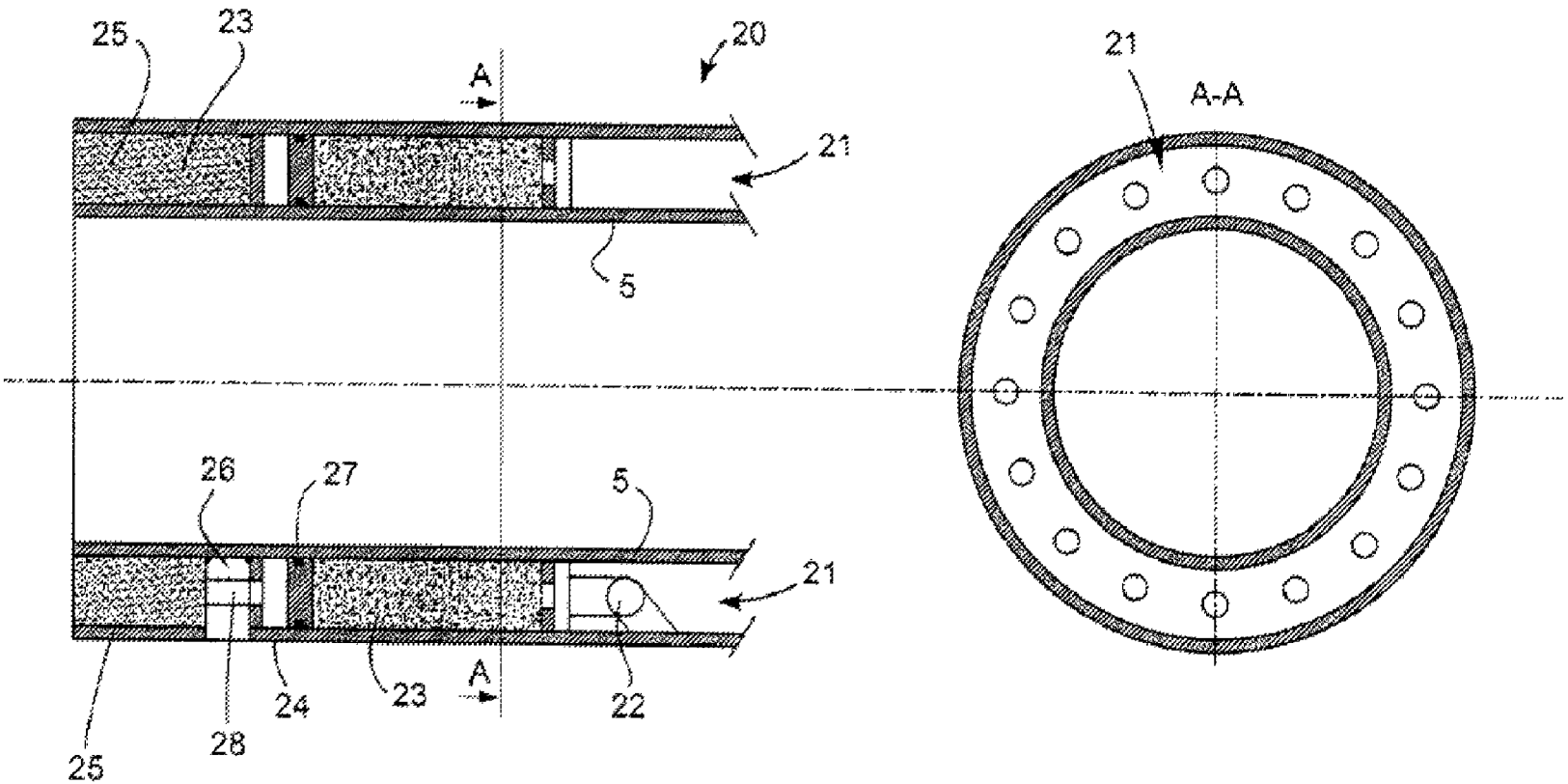
FIG. 2 shows a schematic drawing of an embodiment of the invention.

FIG. 2 shows a tubular section containing an assembly for establishing a packer on the outside of the tubular and, on the left in the Figure, the components of the assembly are shown incorporated into the tubular wall 21. The tubular 20 comprises several longitudinally extending cavities in which means are provided for establishing the barrier.

The injection of fluid into the packer takes place by means of a piston 27 that may be displaced by means of pressurized gas or an electric pump contained in the energy section 25. However, systems for performing such injection of the fluid may assume a wide variety of configurations and it follows that the invention should not be limited to the above-mentioned embodiments.

The activation of the assembly shown in FIG. 2 is accomplished by means of the trigger unit 26 arranged between the fluid section 23 and the energy section 25. The trigger unit 26 may control a valve (not shown) arranged between the energy section 25 and the fluid section 23.

Similar to other embodiments, the expandable packer may also be incorporated into the wall of the tubular. The wall of the tubular may be provided with suitable openings on the outside through which the packer expands. In one configuration, the packer is not arranged into the tubular walls, but the packer's valve arrangement is. The valve system of the packer may be valve system 22. FIG. 2 shows that the openings are constituted by holes 22, but the openings may also have other configurations.

Figure 3:
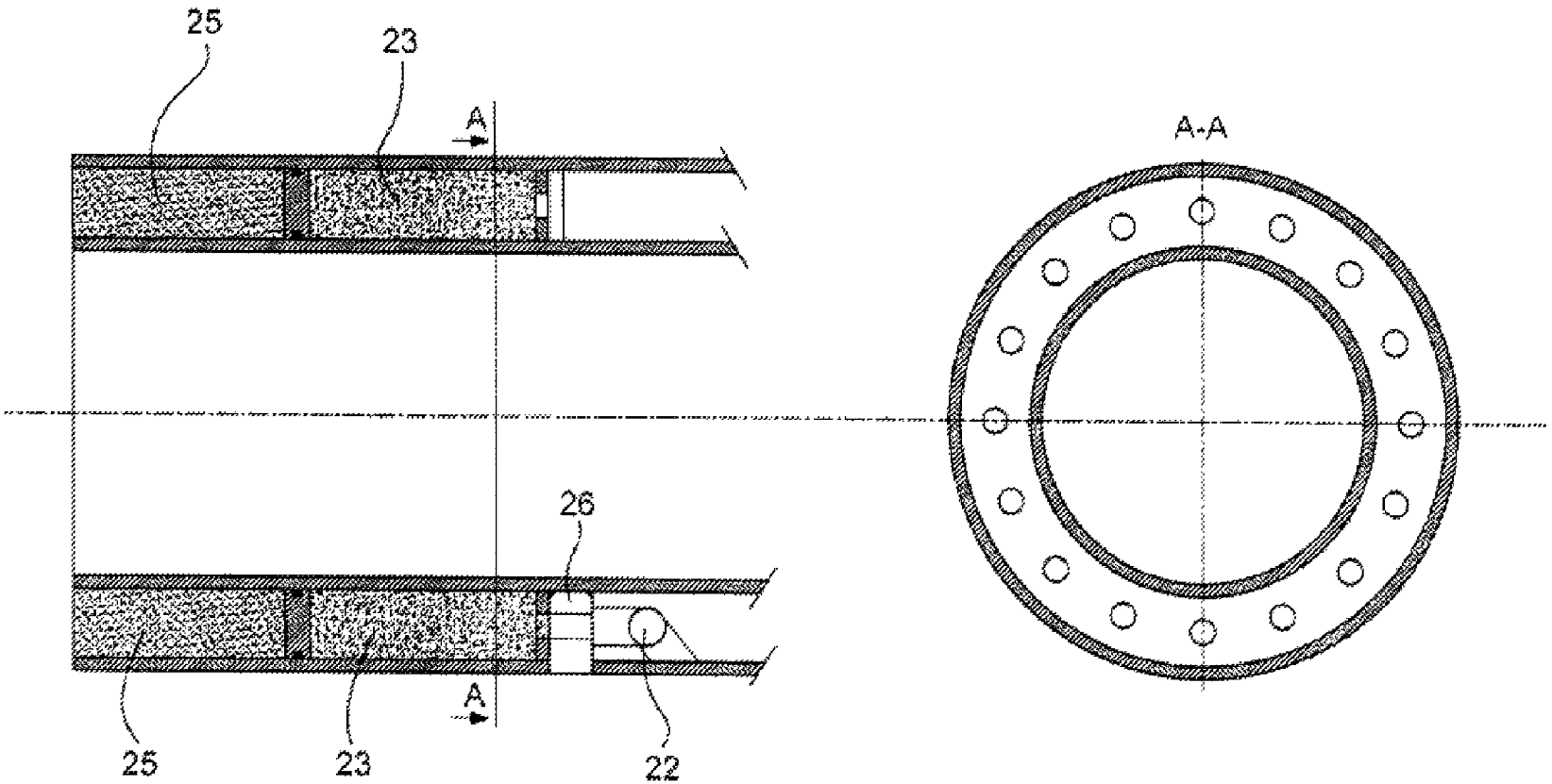
FIG. 3 shows a schematic drawing of another embodiment of the invention.

FIG. 3 shows a further embodiment of an assembly according to the invention. The trigger unit 26 is arranged between the section containing the expandable packer's fluid injection valves 22 and the section 23 containing fluid. By arranging the units in this way, a very accurate dosing of fluid into the expandable packer may be accomplished.

Figure 4:
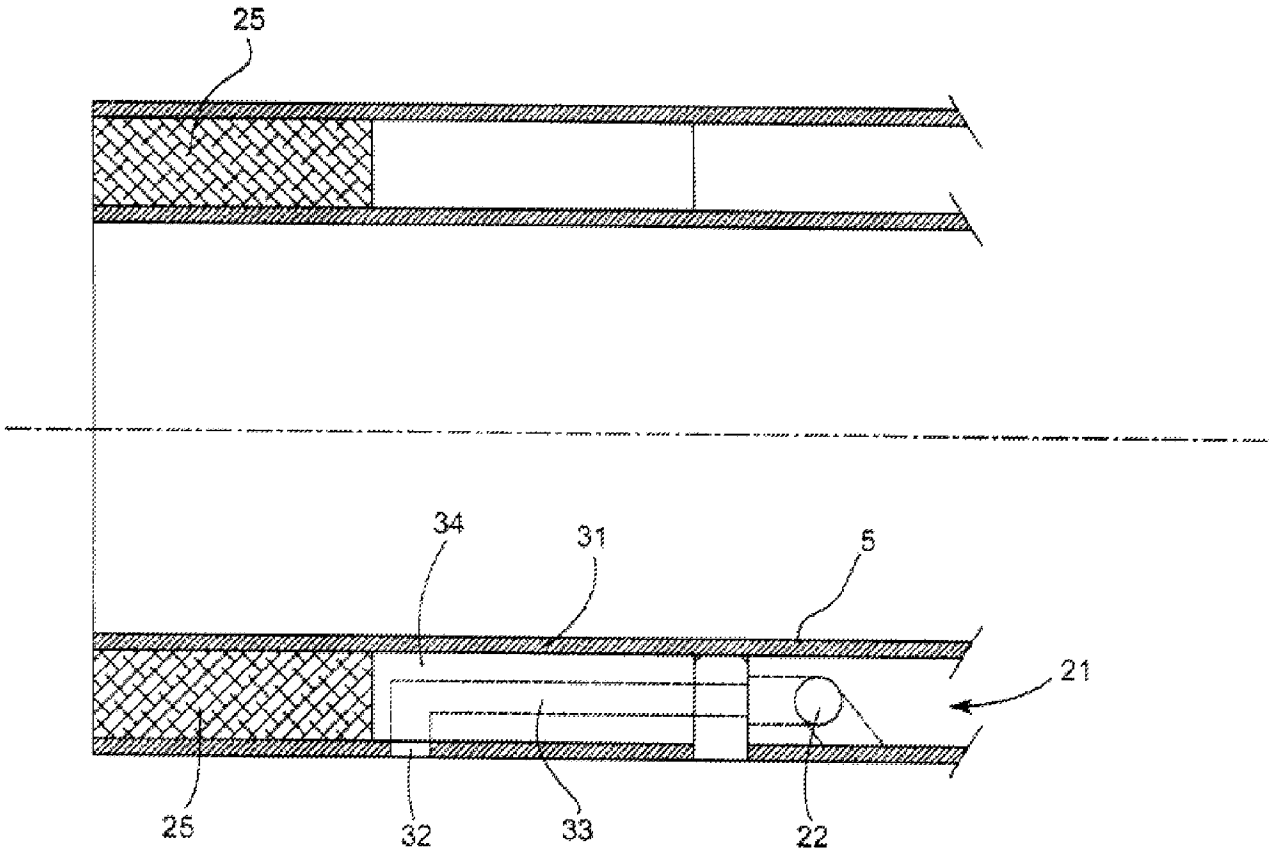
FIG. 4 shows a schematic drawing of yet another embodiment of the invention.

FIG. 4 shows an alternative embodiment of the invention, in which the assembly does not contain a section with fluid. Instead, the assembly includes a tubular section 31, in which means are provided to enable expansion of the packer(s) through pumping by means of the liquid(s) that are present in the oil reservoir. For instance, those means may be an electric pump 34 (not shown in detail) that pumps liquid from an opening in the tubular 32 to the packer section 5 via a passage 33 configured in the wall of the tubular. The assembly may be configured with a packer that contains (or is supplied with) a swellable material.

Figure 5:
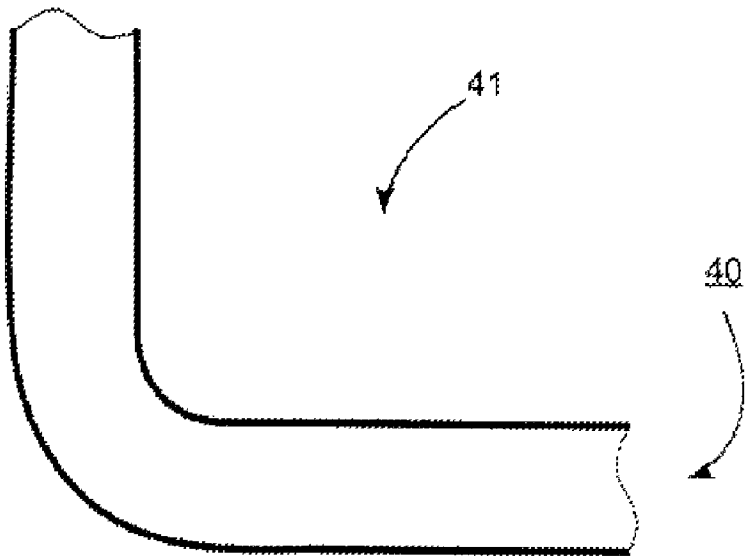
FIG. 5 shows a schematic drawing of a well.
Figure 6:
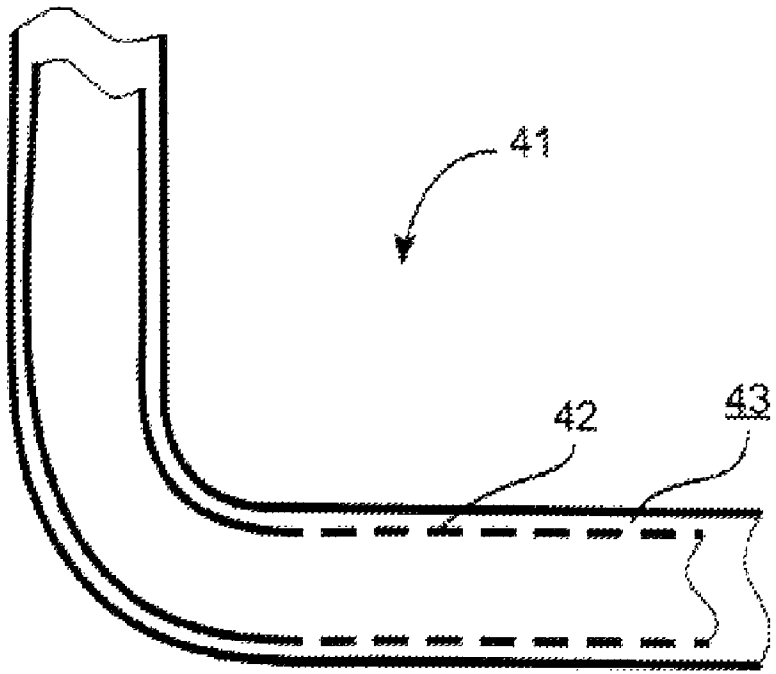
FIG. 6 shows a schematic drawing of a well being equipped with a perforated tubular.

FIG. 5 shows a horizontal well 40 drilled into the formation 41. FIG. 6 shows that the well 40 has been drilled and a well tubular 42 is introduced into the well. The well tubular may be a casing or a liner. The outside diameter of the casing is smaller than the inside diameter of the wellbore, providing thereby an annular space 43, or annulus, between the tubular and the wellbore. The well tubular is perforated 42 at one or more zones to allow hydrocarbons to flow into the tubular. In order to stimulate the well fluid, acid may be discharged into the annular space through these openings configured in the wall of the tubular 42. One or more assemblies according to the invention (not shown in FIG. 6) may be run in conjunction with the well tubular 42.

Figure 7:
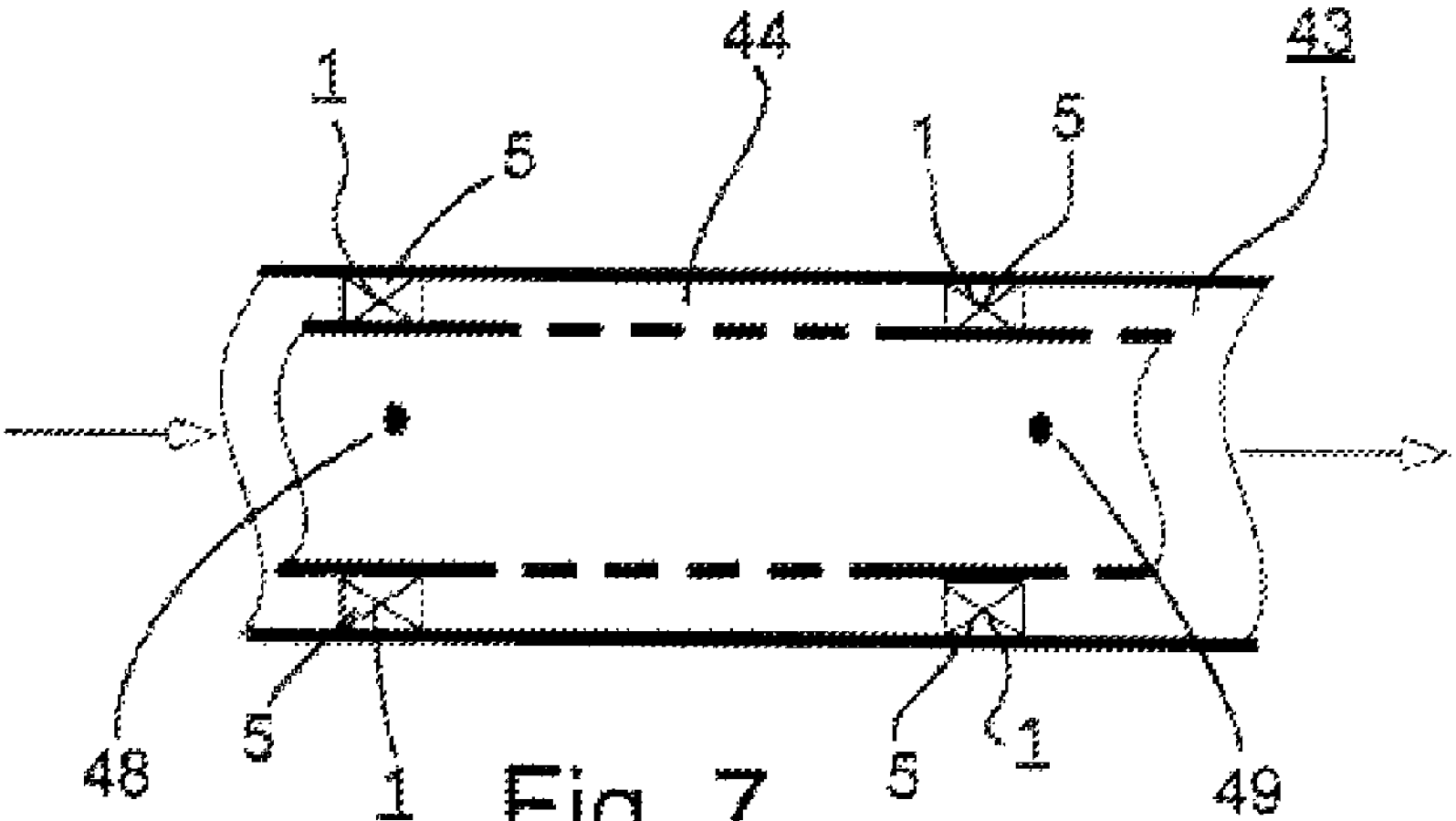
FIG. 7 shows a schematic drawing of a well having a tubular equipped with an embodiment of the invention inserted therein.

FIG. 7 shows how assemblies according to the invention may be used to establish an isolated zone 44 between two packers 5. The assemblies 1 may have been activated by two RFID chips 48, 49 which may have been pumped from the surface and down through the tubular.

Figure 8:
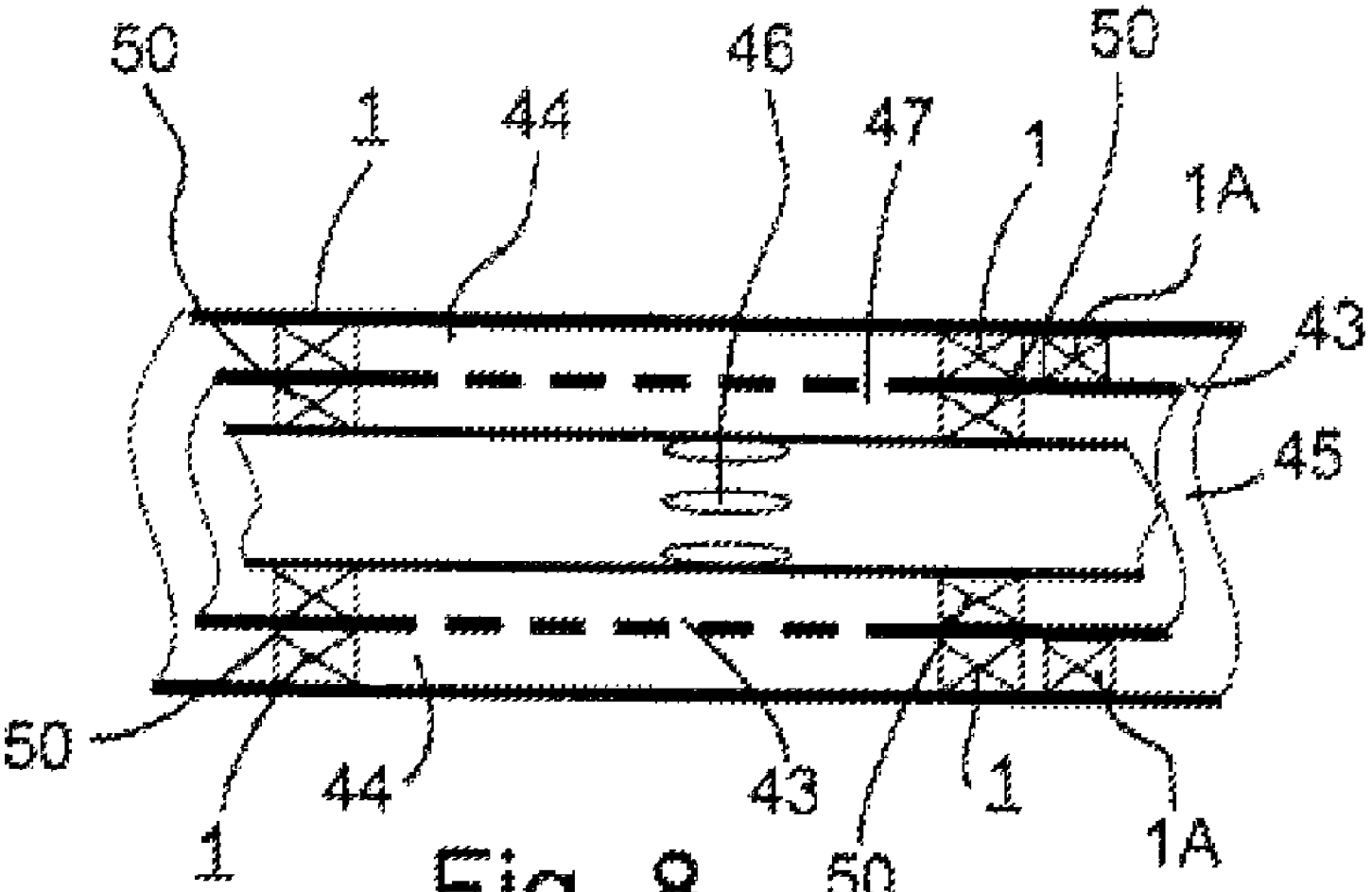
FIG. 8 shows the use of an inner tubular together with an embodiment of the invention.

FIG. 8 shows an embodiment where an inner tubing 45 is introduced into said well tubular thereby providing a gap 47 between the inner tubing and the well tubular 43. The inner tube 45 has means 50 for sealing off the specific part of the gap 47 being in fluid communication with the isolated zone 44 established between the expanded packers 5. FIG. 8 shows the inner tube 45 provided with a closable opening 46 that may be operable from the surface. Thus the inner tube 45 may be chosen to be in fluid communication with the isolated zone 44 between the packers 5. By establishing several independent arrangements in a well, such as shown in FIG. 8, it may be possible to open up or close off selected parts of the well.

Figure 9:
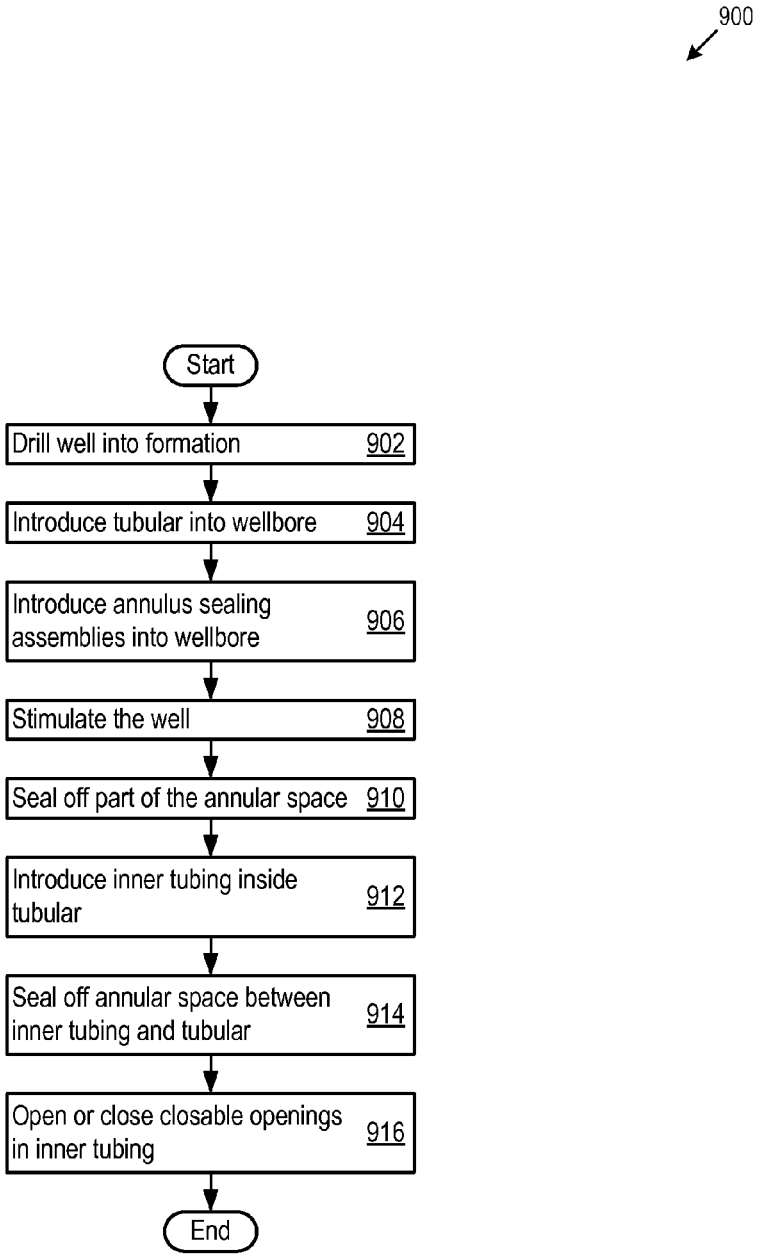
FIG. 9 shows a flow diagram for sealing an annulus.

FIG. 9 shows a flow diagram 900 for an exemplary embodiment of a method for sealing an annulus. A well is first drilled into a formation (902). The well may be drilled according to conventional systems and methods. An illustration of an example drilled well is presented in FIG. 5. Next, a tubular is introduced into the wellbore of the well (904). The tubular may be a well casing or a well liner. The introduction of the tubular may create a gap between the tubular and the surrounding formation in the wellbore. An illustration of an example tubular introduced into the well is presented in FIG. 6.

Annulus sealing assemblies are introduced into the wellbore (906). The annulus sealing assemblies may be one or more of the assemblies presented in FIGS. 1, 2, 3, or 4. The annulus sealing assemblies may be all the same type of assembly, they may all be different, or they may be some combination of types of assemblies. The annulus sealing assemblies may be introduced concurrently with the tubular into the wellbore or at a later point in time than the tubular. For example, the annulus sealing assemblies may be attached to the inner or outer surface of the tubular prior to introduction into the wellbore. Alternatively, the annulus sealing assemblies may be components of the tubular.

The well is then stimulated (908). An acid or aggressive fluid may be introduced into the well through the tubular to stimulate the well. The acid or aggressive fluid may reach the formation by passing from the inside of the tubular to the annular space between the tubular and the formation through openings in the tubular.

A section of the annular space between the tubular and the formation is sealed off (910). The section may be sealed off by activating the annulus sealing assemblies. An illustration of an example sealed-off annular space is presented in FIG. 7. It may be advantageous to seal off a section of the annular space where the section evidences a high concentration of contaminants. The contaminants may include sand, soil, ground debris, water, heat, and/or pressure. The section may alternatively be sealed off to provide additional structural support for the tubular.

An inner tubing is introduced inside the tubular (912). The introduction of the inner tubing produces a gap between the inner tubing and the tubular. The inner tubing may include or comprise annulus sealing assemblies. The annulus sealing assemblies for the inner tubing may be the same as or different from the annulus sealing assemblies for the tubular.

An annular space between the inner tubing and the tubular is sealed off (914). The annular space may be sealed off by triggering the annulus sealing assemblies for the inner tubing. An illustration of the sealed-off annular space between the inner tubing and the tubular is presented in FIG. 8.

The inner tubing may have one or more closable openings in its surface. The closeable openings may be opened or closed (916). The closable openings may be operable from the surface to establish or cut off fluid flow between the inside of the inner tubing and the annular space between the inner tubing and the tubular. Because the annular space between the inner tubing and the tubular may be open to the annular space between the tubular and the formation through perforations in the tubular, the closable openings can regulate fluid flow between the inside of the inner tubing and the fluid in the annular space outside the tubular. Thus, the closeable openings can selectively access oil, gas, or other fluids from the formation and/or selectively deliver acid or aggressive fluid to stimulate specific sections of the formation. Note that in this embodiment, the steps may occur in varied order.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section, wherein the triggering device is capable of being pumped through the well tubular.

2. The assembly of claim 1 comprising two inflatable packer sections, each inflatable packer section operable to be expanded by a fluid, and each inflatable packer section provided with a valve for opening and closing of fluid communication into the inflatable packer section.

3. The assembly of claim 1, wherein the triggering section triggers the expansion of the inflatable packer section after a set time delay.

4. The assembly of claim 1, wherein the inflatable packer section is made from a rubber-based inflatable material.

5. The assembly of claim 1, wherein the energy source comprises a pressurized gas.

6. The assembly of claim 1, wherein the energy section further comprises a chamber at atmospheric pressure, the energy section operable to utilize a pressure differential between the atmospheric pressure and a wellbore fluid pressure as the energy source.

7. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section;

a temperature sensor operable to monitor well temperature; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section.

8. The assembly of claim 7, wherein the triggering section triggers with a certain time delay after a pre-selected temperature is monitored by the temperature sensor.

9. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section;

a pressure sensor operable to monitor well pressure; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section.

10. The assembly of claim 9, wherein the trigger section triggers with a certain time delay after a pre-selected pressure is monitored by the pressure sensor.

11. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section, wherein the trigger section triggers when a pre-selected radio frequency identification chip passes through the triggering section.

12. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section, wherein the trigger section triggers when a pre-selected acoustic signal is provided.

13. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section, wherein the energy section further comprises at least one electrical pump operable to supply the fluid to the inflatable packer; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section.

14. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section;

a fluid section in fluid communication with the inflatable packer section, the fluid section comprising the fluid for expanding the inflatable packer section, wherein the fluid in the fluid section is a two-compound system that hardens after mixing; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section.

15. The assembly of claim 14 further comprising a connection sub arranged between the packer section and the fluid section, the connection sub operable to mix a two-compound fluid system.

16. An assembly run in conjunction with a well tubular arranged in a well bore, the assembly comprising:

an inflatable packer section operable to be expanded by a fluid, the inflatable packer provided with a valve for opening and closing of fluid communication into the inflatable packer section;

an energy section comprising an energy source operable to deliver fluid into the inflatable packer section;

a fluid section in fluid communication with the inflatable packer section, the fluid section comprising the fluid for expanding the inflatable packer section;

a connection sub arranged between the packer section and the inflation fluid section, the connection sub operable to mix a two-compound fluid system; and a triggering section comprising:

an energy source controller operable to regulate delivery of the fluid into the inflatable packer section by controlling one or more of the energy source and the valve; and a communicator operable to communicate with a triggering device to initiate the expansion of the inflatable packer section.

* * * * *